US007044467B1

(12) United States Patent
Dimmig

(10) Patent No.: US 7,044,467 B1
(45) Date of Patent: May 16, 2006

(54) SENTENCE FORMING GAME AND ITS ASSOCIATED METHOD OF PLAY

(76) Inventor: Christine A. Dimmig, 1517 Ayden La., Chalfont, PA (US) 18914-3765

( * ) Notice: Subject to any disclaimer, the term of this patent is extended or adjusted under 35 U.S.C. 154(b) by 5 days.

(21) Appl. No.: 10/771,955

(22) Filed: Feb. 5, 2004

(51) Int. Cl.
*A63F 3/00* (2006.01)

(52) U.S. Cl. ..... 273/272; 434/172

(58) Field of Classification Search ..... 434/167, 434/170, 171, 172; 273/272, 299, 240, 429, 273/430, 431, 432
See application file for complete search history.

(56) References Cited

U.S. PATENT DOCUMENTS

| | | | | |
|---|---|---|---|---|
| 341,754 | A | 5/1886 | Kenyon | |
| 3,191,938 | A * | 6/1965 | Smith | 273/272 |
| 3,333,351 | A * | 8/1967 | Williams | 434/171 |
| 3,389,480 | A * | 6/1968 | Holland | 273/272 |
| 3,394,471 | A * | 7/1968 | Holten | 273/273 |
| 3,482,333 | A * | 12/1969 | Trager, Jr. | 273/299 |
| 3,618,231 | A * | 11/1971 | Nason | 273/295 |
| 4,171,816 | A * | 10/1979 | Hunt | 273/272 |
| 4,470,821 | A * | 9/1984 | LeCapelain | 434/172 |
| 4,671,516 | A | 6/1987 | Lizzola et al. | 273/299 |
| 5,395,118 | A * | 3/1995 | Barrett | 273/272 |
| 5,547,199 | A | 8/1996 | Calhoun | 273/299 |
| 5,697,615 | A | 12/1997 | Gilbert | 273/299 |
| 6,422,561 | B1 * | 7/2002 | Schroeder | 273/272 |

* cited by examiner

*Primary Examiner*—William M. Pierce
(74) *Attorney, Agent, or Firm*—Lamorte & Associates

(57) ABSTRACT

A sentence forming board game and its associated method of play. The game apparatus utilizes a board that defines a plurality of spaces. Some of the spaces are identified as specialty spaces. Players are provided a plurality of playing pieces that have a word printed on them. The words printed on the various game pieces are interrelated in that they share a common topic theme. Players are given a starting number of playing pieces. When it is a player's turn, that player tries to form or alter a sentence on the game board using the playing pieces in hand. If a player does form a sentence, that player gets points proportional to the complexity of the sentence that is formed.

11 Claims, 4 Drawing Sheets

SENTENCE FORMING GAME AND ITS ASSOCIATED METHOD OF PLAY

BACKGROUND OF THE INVENTION

1. Field of the Invention

The present invention is related to board games of the type where players place tiles on a game board. More particularly, the present invention relates to board games where players use tiles on the game board to form words or phrases.

2. Description of the Prior Art

Games that use tiles as playing pieces, such as mahjong have been played for centuries. In the United States, there are many types and styles of tile games. One of the most popular of such tile games is Scrabble®, which was invented by Alfred Butts in 1931. In the game of Scrabble®, players are given tiles containing different letters. The players then collect letters and spell words to gather points. Over the years, there have been many variations of the general Scrabble® game, resulting in other tile games with different methods of play. Such prior art games are exemplified by U.S. Pat. No. 5,395,118 to Barrett, entitled Crossword Game Board Apparatus and U.S. Pat. No. 5,697,615 to Gilbert, entitled Word Linking Game.

In such prior art games, the objective of the game is for players to form words from tiles. The formed words are laid out on a board so that other players can form words using letters exposed on the board. The formed words, therefore, overlap, in a crossword-like manner. However, the words are arbitrary and the different words being formed have no grammatical connection to the other words on the board. Furthermore, in word spelling games, educated players have a distinct advantage over less educated players. Educated players typically have larger vocabularies and are better spellers than non-educated players. As such, for the game to be fun for all players, all players should be intellectually matched. This seldom happens in real life.

Players of different educational levels would be much more evenly matched in a game if the object were to form sentences from words, rather than form words from letters. If a game requires that player form sentences from common pre-existing words, the depth of a person's vocabulary and their ability to spell becomes irrelevant. Rather, it is their imagination and creativity in forming sentences from disjointed words that matters. Thus, a child and an adult of vastly different levels of education can be fairly matched.

In the prior art, there do exist a few games where the object of the game is to links words to form sentences. Such prior art games provide cards with multiple words that must be combined to form sentences. Such prior art games are exemplified by U.S. Pat. No. 4,671,516 to Lizzola, entitled Sentence Game and U.S. Pat. No. 5,547,199 to Calhoun, entitled Method Of Playing A Sentence Forming Game. However, most inventions directed toward sentence making are teaching aids that are intended to teach proper grammar skills. Such, teaching aids are exemplified by U.S. Pat. No. 341,754 to Kenyon, entitled Educational Block, and U.S. Pat. No. 3,333,351 to Williams, entitled Teaching Device.

Teachings aids have little play value and such devices cannot be used to play a game with multiple people.

The present invention is a new game and a method of play that requires players to form sentences from word tiles. However, the game is designed so that multiple players of different educational levels can play the game simultaneously. Furthermore, the game combines question answering along with sentence formation during play. This greatly increases the play value of the game and makes the game more fun and less of an academic endeavor than other sentence forming games. The requirements of the new game are described and claimed below.

SUMMARY OF THE INVENTION

The present invention is a sentence forming board game and its associated method of play. The game apparatus utilizes a board that defines a plurality of spaces. Some of the spaces are identified as specialty spaces. Players are provided a plurality of playing pieces, such as tiles, that have a word printed on them. The words printed on the various game pieces are interrelated in that they share a common topic theme. Players are given a starting number of playing pieces. When it is a player's turn, that player tries to form a sentence on the game board using the playing pieces in hand. If the player cannot form a sentence, that player is provided an opportunity to alter the playing pieces in his/her possession. If a player does form a sentence, that player gets points proportional to the complexity of the sentence that is formed. If a player forms a sentence on the game board over one of the specialty spaces, that player is required to take and answer a question card. If the question card is successfully answered, the player gets bonus points.

The player with the most points at the end of the game wins the game.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE DRAWINGS

The present invention uses words that are printed on playing pieces, such as tiles. The general objective of the game is to form sentences using the words given to each player. Since the game can come with only a finite number of words, the words selected for use preferably share a common theme. In this manner, words selected from the same themed category are easier to form into sentences than are unrelated words. There are many themes that can be used for the present invention game. In the embodiment of the game illustrated and described, the game has an 'adult' theme. Thus, the game is intended to be played by players over the age of eighteen and is generally directed toward love and adult relationships. However, such an embodiment is merely exemplary and the game can be directed to any demographic, including individual grade levels, such as $4^{th}$ grade, $5^{th}$ grade or the like. In such embodiments, the game would use words from the vocabulary curriculum of that grade. Thus, the present invention game can be produced for play by the mass market or can be used by teachers for a target grade level.

Figure 1:
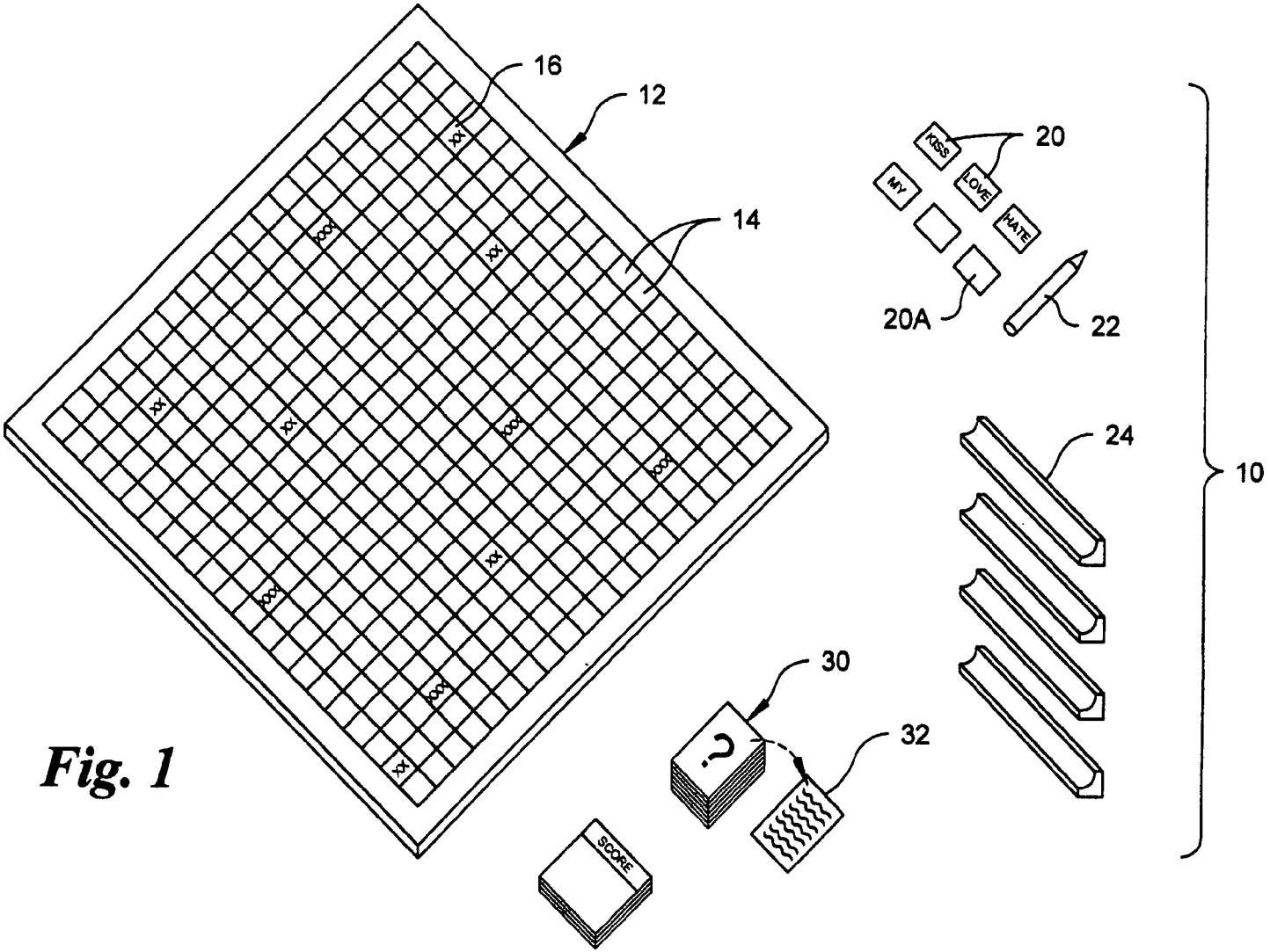
FIG. 1 is a perspective view of one exemplary embodiment of the present invention game assembly.

Referring to FIG. 1, it can be seen that the game assembly 10 of the present invention contains a game board 12 that is divided into a grid, thereby producing a plurality of equally sized playing spaces 14 that are arranged in parallel rows and columns. On the game board 12, certain playing spaces are marked as being specialty spaces 16. In the shown embodiment, there are two types of specialty spaces 16. Some specialty spaces 16 are mark double-X "XX" and some of the specialty spaces 16 are marked with a triple-X "XXX". The use of two types of specialty spaces 16 is exemplary and it should be understood that any plurality of specialty spaces 16 can be used. Furthermore, the number of specialty spaces 16 on the game board 12 can also be varied. However, it is preferred that less than ten percent of the playing spaces 14 be marked as specialty spaces 16.

A plurality of playing pieces 20 are provided. In the shown embodiment, the playing pieces 20 are rectangular tiles. However, other playing pieces, such as paperboard cards can also be used. On most of the playing pieces 20 are printed words. Although words of a particular tense can be printed on the playing pieces, it is preferred that many of the playing pieces 20 contain only the root word. Space is left on the playing piece 20 for the tense of the word to be altered by a player. For instance, one playing piece 20 may have the word "KISS" printed on it. Space is left next to the printed word so that the suffix "ED" or "ING" can be added to the root word, therein producing the word "KISSED" or "KISSING". The root word "KISS" can therefore be selectively changed between a noun and a verb. Similarly, the tense of the word can be changed. An erasable marker 22 is provided with the playing pieces 20 so that players can modify the playing pieces 20 during the course of play.

In addition to the playing pieces 20 that contain words, some of the playing pieces can be blank. The blank playing pieces 20A can be written upon with the erasable marker 22, as will be later explained.

Tile racks 24 can also be provided as part of the game assembly 10. A tile rack 24 is provided to each player or team of players. The tile rack 24 is sized to hold the playing pieces 20 of a player or team so that other players/teams cannot view the playing pieces 20 of their opponents.

A deck of cards 30 is provided. Each card 32 in the deck of cards 30 is printed with at least one question. The questions printed on each card 32 may come in two forms. One form of the question is the straight trivia question. A straight trivia question has a specific answer. Another form of question is the variable question. With a variable question, the answer to the question depends upon the person who is answering the question.

An example of a straight trivia question would be "Who is the Roman god of love?" This question has only one distinct answer. Examples of a variable question would be; "How old were you when you received your first kiss?", or "On a scale of 1 to 10 how sexy is the person to your left?" Each variable question has an answer that is known only to the person answering the question.

The straight trivia questions and the variable questions can be printed on a single deck of cards 30. This embodiment is illustrated. Alternatively, separate decks can be used, where one deck contains only straight trivia questions and a separate deck contains variable questions.

The words printed on the playing pieces 20 have a common theme. In the embodiment of the game assembly 10 herein described, the game assembly 10 has an adult theme. Words used on the playing pieces 20 for such a theme may in include "kiss" "touch", "love" and the like. This same theme is followed by the questions selected on the playing cards 32. As such, the straight trivia questions and the variable questions used on the playing cards 32 will be directed toward love and adult relationships. It will therefore be understood that both the playing pieces 20 and the deck 30 of playing cards 32 are interrelated in that both game components share a common theme.

The game assembly 10 also includes scorecards 34 so that players or teams of players can keep a running score of the point totals gathered during play.

Figure 2:
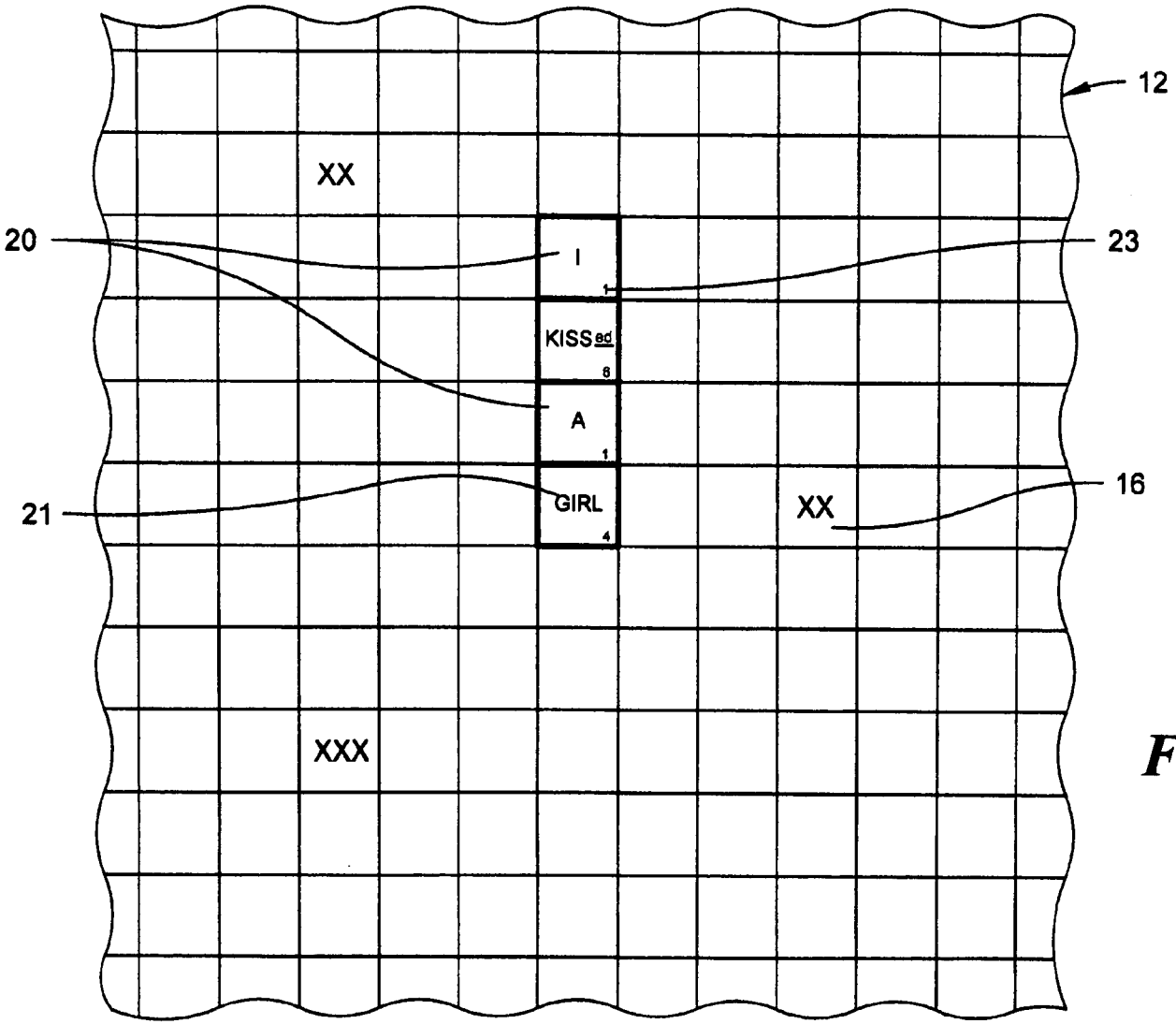
FIG. 2 is an enlarge view of a segment of the game board having playing pieces from a first player placed thereon.

Referring to FIG. 2, it can be seen that on each of the playing pieces 20, there is printed a word 21 and a point value 23 for that word 21. Words such as "I" or "THE" that are commonly used in sentences have low point values. Less common words, such as "KISS" have higher point values. The point value 23 assigned to the word 21 is directly proportional to its rarity of occurrence in plain language. Blank playing pieces 20A are provided that have a low value.

In playing the present invention game assembly, each player or team of players must create or alter a full sentence on the game board 12 using the playing pieces 20. During a turn at play, a player or team places the playing pieces 20 on the game board 12 to form a proper sentence or alter an existing sentence. That player or team then gets a point total equal to the sum of the point values 23 printed on the playing pieces 20 that were used in the sentence. In the shown example, the sentence "I kissed a girl" is illustrated. It should be noted that the second playing piece has only the word "KISS" permanently printed on it. The suffix "ed" was added by a player using the erasable marker 22 (FIG. 1).

Figure 3:
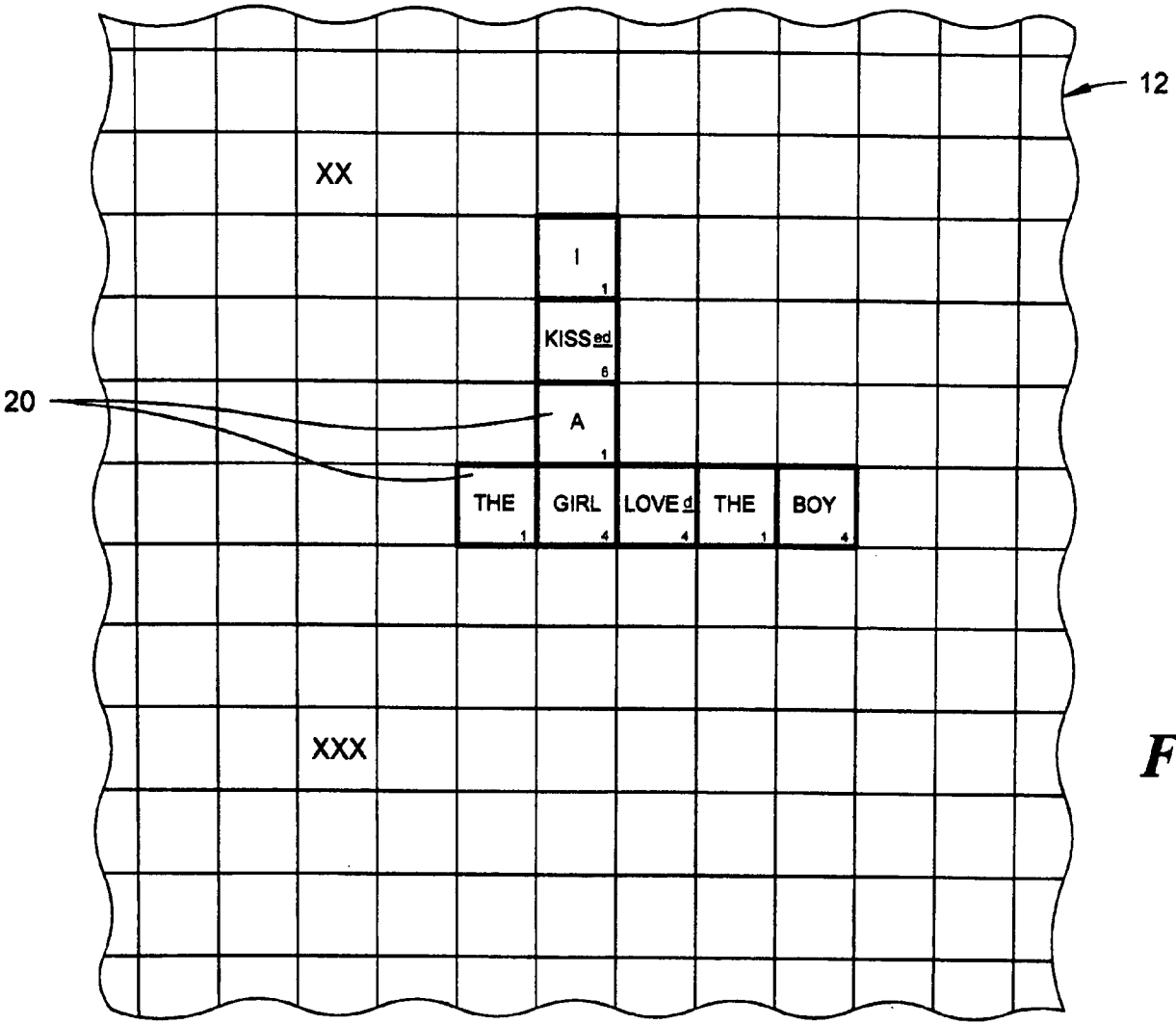
FIG. 3 is an enlarge view of a segment of the game board having playing pieces from both a first and a second player placed thereon.

From FIG. 2, it can be seen that specialty spaces 16 exist on the game board 12. One such specialty space 16 is positioned two spaces right of the word "GIRL". Referring to FIG. 3, it can be seen that a subsequent player has placed playing pieces 20 on the game board 12 and has created the sentence, "The girl loved the boy" on the game board 12. The second sentence of FIG. 3 used the "GIRL" playing tile of the first sentence of FIG. 2. Furthermore, the second sentence ended on specialty space 16 (FIG. 2).

When a sentence lies across a specialty space 16, a player or team must select a playing card 32 (FIG. 2) from the card deck 30 (FIG. 2). The player or team must then answer the question on the selected card. If individual players are playing, the individual who selects the playing card 32 must correctly answer a trivia question. If a straight trivia question is selected, the player must answer the question correctly. However, a variable question is selected, other players, either from the same team or opposing players, must then form a predicted answer to that variable question. If the predicted answer matches the actual answer, the question is answered correctly.

To score the second sentence shown in FIG. 3, the player gets the sum of the words in the sentence. Furthermore, if the question from the selected playing card is answered correctly, a bonus is added to the score. In the shown embodiment, some of the specialty spaces 16 have a double-X and some have a triple-X. If a player lays a sentence over a double-X specialty space and correctly answers the question, the player gets a double point bonus. Similarly, if a player lays a sentence over a triple-X specialty space and correctly answers the question, the player gets a triple point bonus.

A player or team may not have enough playing pieces 20 to form a new sentence. In such a circumstance, a team or player can alter an existing sentence that is already on the game board. For example, the illustrated sentence "I kissed a girl" can be altered to "I kissed the ugly girl" by the addition of the word "ugly". A player or team can alter any existing sentence, provided the alteration does make improper the grammar of any sentence on the game board. If a team or player does alter a sentence, he/they get the points of all the playing pieces 20 used in that sentence.

Figure 4:
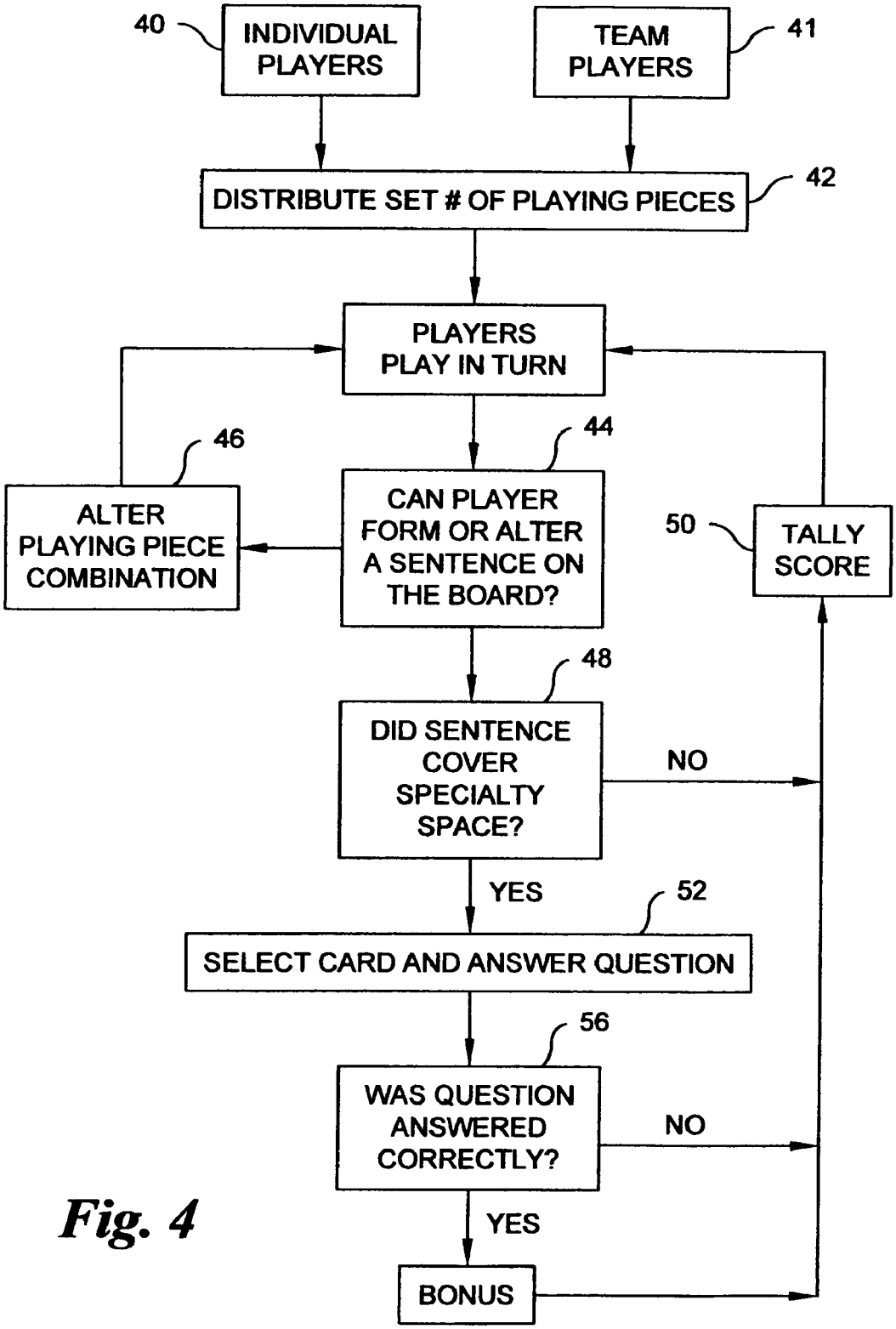
FIG. 4 is a block logic diagram illustrating an exemplary method of play for the game assembly.

With the basic features of the present invention game assembly 10 having been described, the full method of play should now be easily understood. Referring to FIG. 4, it can be seen that players play either as individuals (Block 40) or on teams (Block 41). As is indicated by Block 42, each player or team is given a number of playing pieces to start. The playing pieces are randomly selected from all the playing pieces that come with the game assembly. The playing pieces include the various playing pieces with preprinted words and a few blank playing pieces.

As is indicated by Block 44, each player or team in turn attempts to create or alter a sentence on the game board. If they cannot form or alter a sentence, the player/team can exchange all or some of the playing pieces. See Block 46.

If a player/team can form or alter a sentence, they place a number of playing pieces on the game board to form the sentence. Any player/team can use any playing piece that is already on the game board in forming a new sentence, in a crossword fashion.

As indicated by Block 48 and Block 50, if the sentence placed on the game board does not cross a specialty space, the player/team tallies their score from the playing pieces used in making their sentence. However, as indicated by Block 48 and Block 52, if a player/team does place a sentence over a specialty space, that player/team must select a playing card and answer the question printed on that card.

If the question from the playing card is answered successfully, the player/team tallies their score from the word value of the playing tiles used, plus the bonus from answering the question from the playing card. See Block 56.

The length of the game can be determined by a time period or until playing pieces or game board spaces run out. At the end of the game, a player or team tallies their total and deducts the value of any playing pieces that are in their possession but are unused. The player or team that has accumulated the most points at that time wins the game.

It will be understood that the embodiment of the present invention illustrated is merely exemplary and that many variations to the shown embodiment can be made. For example, the size and shape of the game board can be varied in any manner, provided the game board has columns and rows onto which playing tiles can be placed. Furthermore, the number and bonus values of specialty spaces on the game board can be varied in any manner. Furthermore, it is desired that all the playing tiles share a common theme topic. This makes it much easier to form interesting sentences. However, the selected topic theme can be varied to the whims of the manufacturer. It is also desired that the questions on the playing cards share the same overall theme to the words used on the playing tiles. In this manner, both the playing pieces and the playing cards are connected.

All such variations, alternate embodiments and modifications are intended to be included within the scope of the invention as set forth in the claims below.

What is claimed is:

1. A method of playing a sentence forming game, comprising the steps of:

providing a plurality of printed words, wherein each of said printed words has a corresponding scoring value;

randomly distributing some of said plurality of printed words to opposing players;

having opposing players selectively altering at least some of said printed words by adding suffixes to at least some of said printed words; and having the opposing players take alternate turns forming complete sentences by arranging said printed words.

2. The method according to claim 1, wherein said step of providing a plurality of printed words includes printed words sharing a common topic theme.

3. The method according to claim 1, wherein said step of providing a plurality of printed words includes providing a plurality of tiles, wherein a word is printed on each tile.

4. The method according to claim 1, further including the step of providing a game board having a grid of spaces, wherein said step of forming complete sentences by arranging said printed words includes placing said printed words on said game board.

5. The method according to claim 4, wherein said step of forming complete sentences by arranging said printed words includes intersecting sentences on said game board so that one printed word on said game board is part of multiple sentences on said game board.

6. The method according to claim 4 further including the step of identifying some of said spaces on said game board as specialty spaces.

7. The method according to claim 6, further including the step of providing at least one deck of question cards.

8. The method according to claim 7, further including the step of having a player select and attempt to answer one of said question cards when that player places a printed word over one of said specialty spaces on said game board.

9. A method for playing a sentence formation game, comprising the steps of:

providing players with a predetermined number of game pieces that have words printed thereon;

providing a game board having playing spaces thereon, wherein at least some of said playing spaces are designated as specialty spaces;

providing at least one deck of question cards;

having players alternately attempt to form sentences on said playing spaces with said game pieces;

having a player select and attempt to answer one of said question cards when that player places a game piece over one of said specialty spaces on said game board; and providing at least one new game piece to each player that fails to form a sentence.

10. The method according to claim 9, further including the step of enabling a player to alter the tense of a word printed on a playing piece.

11. A method of playing a sentence forming game, comprising the steps of:

providing a game board having a grid of playing spaces;

providing a plurality of printed words, wherein each of said printed words has a corresponding scoring value;

randomly distributing some of said plurality of printed words to opposing players;

having the opposing players take alternate turns forming complete sentences by arranging said printed words on said playing spaces of said board game;

providing at least one deck of question cards; and identifying some of said spaces on said game board as specialty spaces that require the drawing of a question card from said at least one deck of question cards.

* * * * *